US006485680B2

(12) United States Patent
Ragot et al.

(10) Patent No.: US 6,485,680 B2
(45) Date of Patent: Nov. 26, 2002

(54) RESULFURIZED AUSTENITIC STAINLESS STEEL

(75) Inventors: Jean Ragot, Albertville (FR); Jean-Michel Hauser, Ugine (FR); Christian Trombert, Tours-en-Savoie (FR)

(73) Assignee: Ugine-Savoie Imphy, Ugine (FR)

( * ) Notice: Subject to any disclaimer, the term of this patent is extended or adjusted under 35 U.S.C. 154(b) by 0 days.

(21) Appl. No.: 09/797,949

(22) Filed: Mar. 5, 2001

(65) Prior Publication Data

US 2001/0046449 A1 Nov. 29, 2001

(30) Foreign Application Priority Data

Mar. 3, 2000 (FR) ..... 00 02718

(51) Int. Cl.[7] ..... C22C 38/60; C22C 38/42; C22C 38/44

(52) U.S. Cl. ..... 420/42; 420/41; 420/49; 420/61; 148/325; 148/327

(58) Field of Search ..... 420/42, 41, 49, 420/61; 148/325, 327

(56) References Cited

U.S. PATENT DOCUMENTS 5,089,224 A * 2/1992 Bletton et al. ..... 420/41
5,362,439 A * 11/1994 Bletton et al. ..... 420/41
5,656,237 A * 8/1997 Terrien et al. ..... 420/41

* cited by examiner

*Primary Examiner*—Deborah Yee
(74) *Attorney, Agent, or Firm*—Oblon, Spivak, McClelland, Maier & Neustadt, P.C.

(57) ABSTRACT

Resulfurized stainless steel with high machinability and having an improved corrosion resistance, which includes, in its composition, anorthite- and/or pseudo-wollastonite- and/or gehlenite-type lime aluminosilicate inclusions combined with CrMnS inclusions, the chromium content of which is between 30% and 70%.

12 Claims, 6 Drawing Sheets

RESULFURIZED AUSTENITIC STAINLESS STEEL

BACKGROUND OF THE INVENTION

1. Field of the Invention

The present invention relates to a resulfurized stainless steel with high machinability and having an improved corrosion resistance, which is especially suited to use in the field of very-high-speed machining and screw machining.

2. Description of the Background

European Patent No. 403 332 teaches a resulfurized steel with improved machinability. That document describes a process in which it is proposed, in order to improve the machinability, to introduce, into a steel having the following general composition: carbon less than 0.15%, silicon less than 2%, manganese less than 2%, molybdenum less than 3%, nickel between 7% and 12% and chromium between 15 and 25%, an amount of sulfur in a proportion of between 0.1 and 0.4%, combined with calcium and oxygen in contents of greater than $30\times10^{-4}$% and $70\times10^{-4}$%, respectively, the calcium and oxygen contents satisfying the Ca/O ratio of between 0.2 and 0.6.

In that document, the desired aim is the formation, with manganese and, in a smaller proportion, with chromium, of a manganese chromium sulfide (Mn,Cr)S which produces, in the form of specific inclusions, solid lubrication of the cutting tool during the machining operations.

It is also taught that sulfur has an unfavorable effect on the corrosion resistance. Despite this, a chosen approach is the introduction, into a resulfurized steel containing manganese sulfide inclusions, of inclusions consisting of lime aluminosilicate oxides. These oxides, most often combined with manganese sulfide inclusions, do not degrade the corrosion resistance.

Such a steel has good machinability properties in the field of conventional cutting speeds, that is to say of less than 500 m/min in turning. The steel includes associated inclusions composed of oxides of the lime aluminosilicate type with manganese sulfide inclusions. These inclusions are larger and more deformable than the sulfide inclusions by themselves.

The effect of the so-called solid lubrication of the cutting tool is thereby improved. However, the steel described in the abovementioned document has the drawback associated with resulfurized steels, i.e. a low corrosion resistance, especially pitting corrosion resistance.

Patent FR 95/04140 discloses a steel with improved machinability that can be used, on the one hand, in the field of very-high-speed machining, with cutting speeds in turning possibly exceeding 700 m/min, and, on the other hand, in the field of screw machining with 30% higher productivities than those obtained with an ordinary resulfurized austenitic stainless steel.

The resulfurized stainless steel with improved machinability that can be used especially in the field of high-speed machining and the field of screw machining has the following weight composition: carbon less than 0.1%; silicon less than 2%; manganese less than 2%; nickel from 7 to 12%; chromium from 15 to 25%; sulfur from 0.10 to 0.55%; copper from 1% to 5%; calcium greater than $35\times10^{-4}$%; oxygen greater than $70\times10^{-4}$%, the ratio of the calcium content to the oxygen content being between 0.2 and 0.6.

Although the characteristics in the field of machinability are improved by the presence of a high copper content, the corrosion resistance properties remain mediocre in this resulfurized steel.

It is taught that manganese sulfides are very hardly substituted with chromium because of a manganese content matched to the sulfur content and that their malleability, and hence their effectiveness during cutting, is thereby improved.

SUMMARY OF THE INVENTION

An object of the present invention is to provide a steel containing sulfur, in order to improve machinability, and having specific inclusions providing a substantial improvement in the field of corrosion resistance, especially pitting corrosion resistance.

The steel of the invention makes it possible to reconcile the level of machinability of resulfurized steels with having a corrosion resistance similar to that of steels of low sulfur content.

One subject of the invention is a resulfurized stainless steel with high machinability and having an improved corrosion resistance, which includes, in its composition, anorthite- and/or pseudo-wollastonite-and/or gehlenite-type lime aluminosilicate inclusions combined with CrMnS inclusions, the chromium content of which is between 30% and 70%.

In one preferred example of the invention, the steel is a resulfurized austenitic stainless steel comprising, consisting essentially of, and consisting of the following composition by weight based on total weight:

0.01% ≦carbon ≦0.1%;

0.01% ≦silicon ≦2.0%;

0.01% ≦manganese ≦0.5%;

10% ≦chromium ≦25%;

7% ≦nickel ≦12%;

0.15% ≦sulfur ≦0.45%;

0.01% ≦molybdenum ≦3.00%;

0.5% ≦copper ≦3.5%;

0.01% ≦nitrogen ≦0.1%;

0.0020% ≦aluminum ≦0.0100%;

0.0005% ≦phosphorus ≦0.050%;

$30\times10^{-4}$% ≦calcium ≦$200\times10^{-4}$%;

$70\times10^{-4}$% ≦oxygen ≦$300\times^{-4}$%;

0.20≦calcium/oxygen ≦0.60, plus iron and residual elements inherent in smelting, the steel preferably containing anorthite- and/or pseudo-wollastonite- and/or gehlenite- type lime aluminosilicate inclusions combined with CrMnS inclusions, the chromium content of which is between 30% and 70%;

the composition by weight furthermore contains less than $3\times10^{-4}$% boron;

the composition by weight furthermore contains from 0.01% to 0.3% vanadium.

BRIEF DESCRIPTION OF THE DRAWINGS

The description which follows and the appended figures, all given by way of non-limiting example, will make the invention more clearly understood.

DISCUSSION

Figure 1:
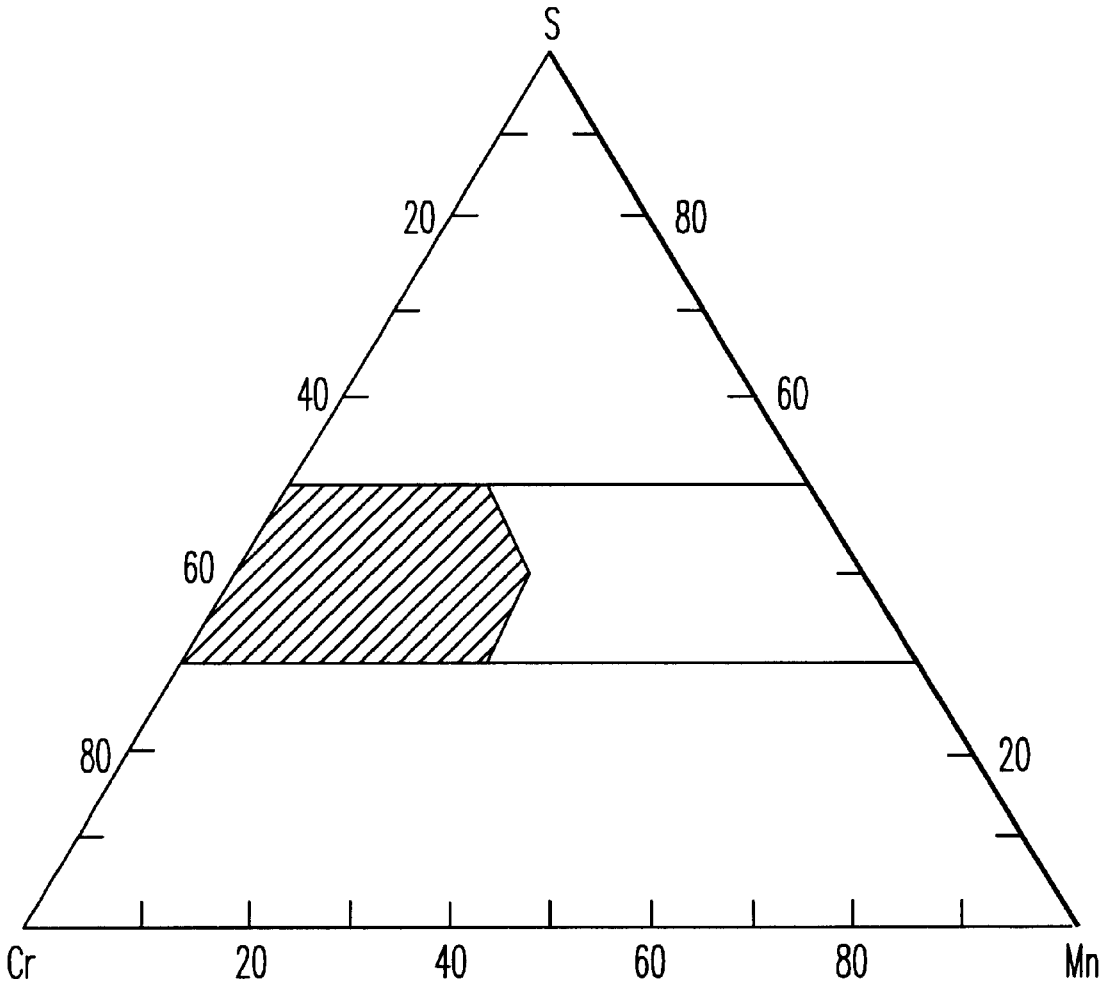
FIG. 1 shows an Fe—Cr—S diagram in which a preferred range of the invention is shown.
Figure 2:
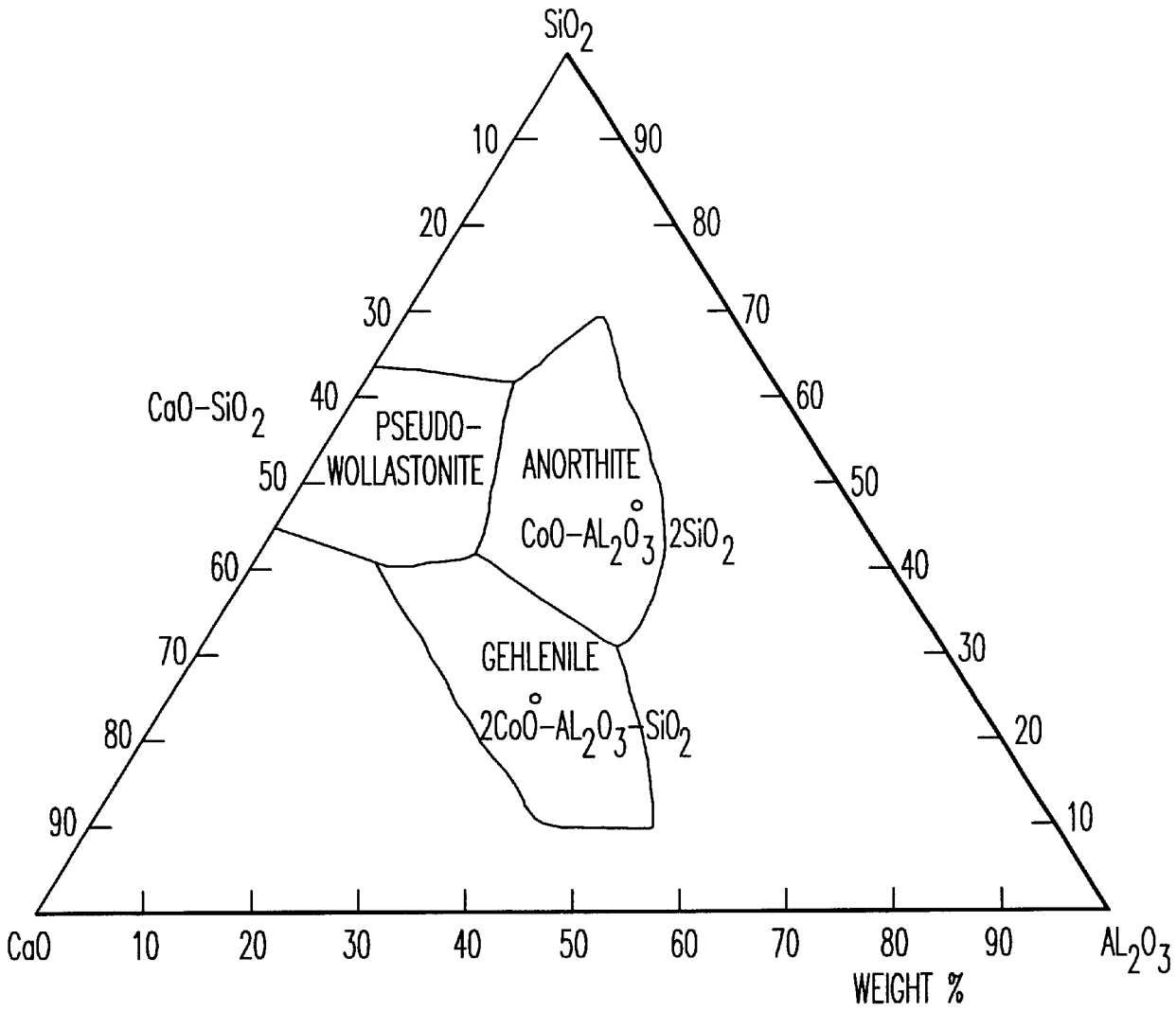
FIG. 2 shows a Ca—Si—Al diagram in which a preferred range of the lime aluminosilicate inclusions of the invention is shown.

Components are produced from long products made of austenitic stainless steels usually by machining. Now, these steels have the drawback of having a low thermal conductivity and a high work-hardenability, locally introducing regions of high hardness with, as consequence, rapid deterioration of the cutting tool when machining them.

The most common solution used to solve this problem is to introduce a large amount of sulfur into their composition.

Sulfur forms, with the manganese present in the steel, manganese sulfides containing a small amount of chromium, about 0% to 20% by composition, which have a favorable effect on chip fragmentation and which increase the lifetime of the cutting tools.

However, sulfur and manganese sulfides in this form degrade the corrosion resistance. Furthermore, resulfurized steels generally contain hard inclusions of the chromite (Cr,Mn,Al,Ti)O, alumina (AlMg)O, and silicate (SiMn)O type which are abrasive for cutting tools.

The choice of steels is dictated by the field of use of the components which will be produced from them, and is within the skill of the ordinary artisan.

Thus, in the case of use in corrosive media, the steels used will be low-sulfur steels, i.e. steels containing in their composition less than 0.035% sulfur, the machinability of which may be improved in a limited manner by about 20% by replacing hard inclusions, for example of the chromite type, with malleable oxides of the lime aluminosilicate type. The level of machinability will in any case remain very much below that of a grade resulfurized by less than about 25%.

If the medium is not very corrosive, the use of resulfurized steels makes it possible, by adding a large amount of sulfur of between 0.15% and 0.45%, to obtain a very large number of manganese sulfides having a low chromium content, i.e. less than about 20%, which are introduced so as to facilitate chip fragmentation and to increase the lifetime of the cutting tools, thereby allowing significant increases in productivity to be achieved when producing the components. The mediocre corrosion behaviour of these steels is associated with the poor corrosion resistance, especially pitting corrosion resistance, of these manganese sulfides not highly substituted with chromium. Here again, replacing hard inclusions with malleable oxides improves the machinability of the steels without in any way modifying the corrosion behaviour, which remains mediocre compared with steels containing no sulfur.

DETAILED DESCRIPTION OF PREFERRED EMBODIMENTS

The steel according to the invention relates to a resulfurized stainless steel with high machinability and having an improved corrosion resistance, which includes, in its composition, anorthite- and/or pseudo-wollastonite- and/or gehlenite- type lime aluminosilicate inclusions combined with inclusions of the compound CrMnS, the chromium content of which is between 30% and 70%.

The compound, containing chromium sulfides as inclusions complementary to the lime aluminosilicate inclusions and providing corrosion resistance, is reduced by lowering as far as possible the manganese content in the composition of the steel during its smelting. The manganese content is chosen to be less than or equal to 0.5%.

The solution consists in obtaining, during smelting, sulfides very rich in chromium, the chromium content being between 30% and 70% of the composition by weight. By virtue of the sulfides, the inventors have found that a resulfurized steel containing from 0.15% to 0.45% sulfur exhibits a behavior in generalized corrosion, crevice corrosion, pitting corrosion and corrosion in salt fog which is similar to that of a non-resulfurized steel, i.e. one containing less than 0.035% sulfur. Furthermore, the combined action of these sulfides containing a major amount of chromium and of malleable oxides, which are anorthite- and/or pseudo-wollastonite- and/or gehlenite- type lime aluminosilicates, makes it possible to maintain a level of machinability from the standpoint of chip fragmentation, cutting conditions and tool lifetime, similar to that of conventional resulfurized steels, the sulfides of which are manganese sulfides containing a small amount of chromium, i.e. from about 0 to 20% chromium, in the composition by weight.

Although the function of the lime aluminosilicate inclusions is that of a solid lubricant with respect to machinability, these inclusions, because of their deformability, also provide the material with good cohesion during its conversion. Thus, the sites of loss of matrix/inclusion cohesion, which initiate corrosion and exist with hard conventional oxides of the chromite (Cr,Mn,Al,Ti)O, alumina (Almg)O, and silicate (SiMn)O type, are eradicated.

Introducing inclusions according to the invention into a steel, in order to obtain sulfide compounds very rich in chromium, with the type lime aluminosilicate inclusions allows higher levels of machinability than those obtained with, only, the sulfide chromium. This combination provides a very good corrosion resistance.

The invention is particularly adapted in the field of austenitic stainless steels.

One preferred example of an application according to the invention is a resulfurized austenitic stainless steel with high machinability and having improved corrosion resistance comprising, consisting essentially of, and consisting of the following composition by weight based on total weight:

$0.01\% \leqq \text{carbon} \leqq 0.1\%$;

$0.01\% \leqq \text{silicon} \leqq 2.0\%$;

$0.01\% \leqq \text{manganese} \leqq 0.5\%$;

$10\% \leqq \text{chromium} \leqq 25\%$;

$7\% \leqq \text{nickel} \leqq 12\%$;

$0.15\% \leqq \text{sulfur} \leqq 0.45\%$;

$0.01\% \leqq \text{molybdenum} \leqq 3.00\%$;

$0.5\% \leqq \text{copper} \leqq 3.5\%$;

$0.01\% \leqq \text{nitrogen} \leqq 0.1\%$;

$0.0020\% \leqq \text{aluminum} \leqq 0.0100\%$;

$0.0005\% \leqq \text{phosphorus} \leqq 0.050\%$;

$30\times10-4\% \leqq \text{calcium} \leqq 200\times10^{-4}\%$;

$70\times10^{-4}\% \leqq \text{oxygen} \leqq 300\times10^{-4}\%$;

$0.20 \leqq \text{calcium/oxygen} \leqq 0.60$, also including, optionally as balance, iron and residual elements inherent in smelting, the steel preferably containing anorthite- and/or pseudo-wollastonite- and/or gehlenite-type lime aluminosilicate inclusions combined with CrMnS inclusions, the chromium content of which is between 30% and 70% by wt. based on total wt. of such CrMnS inclusions.

In a preferred composition of the steels according to the invention as shown in Table 1, aluminum is present as an addition element in order to obtain anorthite-and/or pseudo-wollastonite- and/or gehlenite- type lime aluminosilicates in large number since they are deformable and corrosion-resistant.

Copper limits the forces needed for chip formation. Because of this property, the temperature at the tip of the tool remains at a level that can be withstood by the latter. Copper reduces the work-hardenability. This low work-hardenability results in drawn bars being obtained which are less hard, particularly on the surface.

The copper takes part in the improvement of the steel characteristics.

The steel according to the invention may furthermore contain, in its composition by weight, less than $30\times10^{-4}$% boron and from 0.01% to 0.3% vanadium. The resulfurized steel of the invention, which preferably can be used in the field of screw machining but also in that of so-called high-speed machining, because of the presence of a large number of malleable oxide and chromium-rich sulfide inclusions which may or may not be combined, and also because of the presence of a copper content in the invention, ensures, on the one hand, machining at exceptionally high cutting speeds and, on the other hand, the likewise exceptional corrosion resistance, especially pitting corrosion resistance.

EXAMPLES

Industrial castings have been produced which confirm the advantage, with regard to the intended properties, of sulfides very rich in chromium. We have been able to characterize the corrosion behaviour as being equivalent to that of a non-resulfurized steel with the level of machinability of that of a resulfurized steel.

The compositions of reference steels A and B and of steel C according to the invention are given in Table 1 below for steels whose base composition is: C=0.05%; Si=0.5%; Ni=8.6%; Cr=18%; Mo=0.2%, but the sulfur, calcium, oxygen and magnesium contents of which vary.

TABLE 1

| Steel | Ca (ppm) | O (ppm) | Ca/O | Mn % | Cu % | S % |
|---|---|---|---|---|---|---|
| A | 6 | 85 | 0.07 | 1.60 | 0.5 | 0.02 |
| B | 48 | 130 | 0.35 | 1.60 | 0.5 | 0.30 |
| C (inv) | 40 | 94 | 0.42 | 0.25 | 1.5 | 0.30 |

Figure 3A:
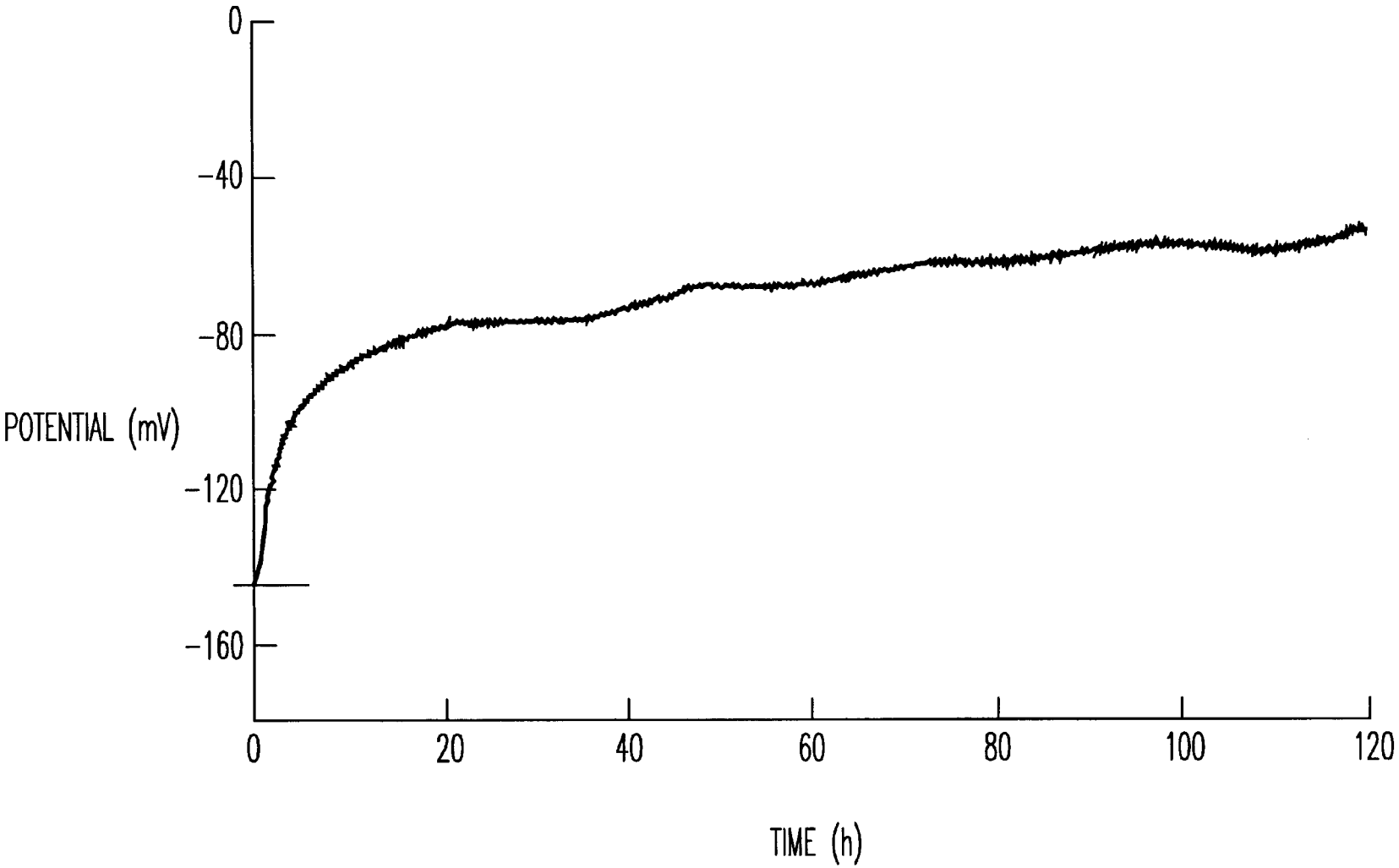
FIGS. 3*a*, 3*b*, 3*c* and 4 show the characteristic curves in pitting corrosion and in crevice corrosion for steel C according to the invention compared with reference steels A and B, respectively.
Figure 3B:
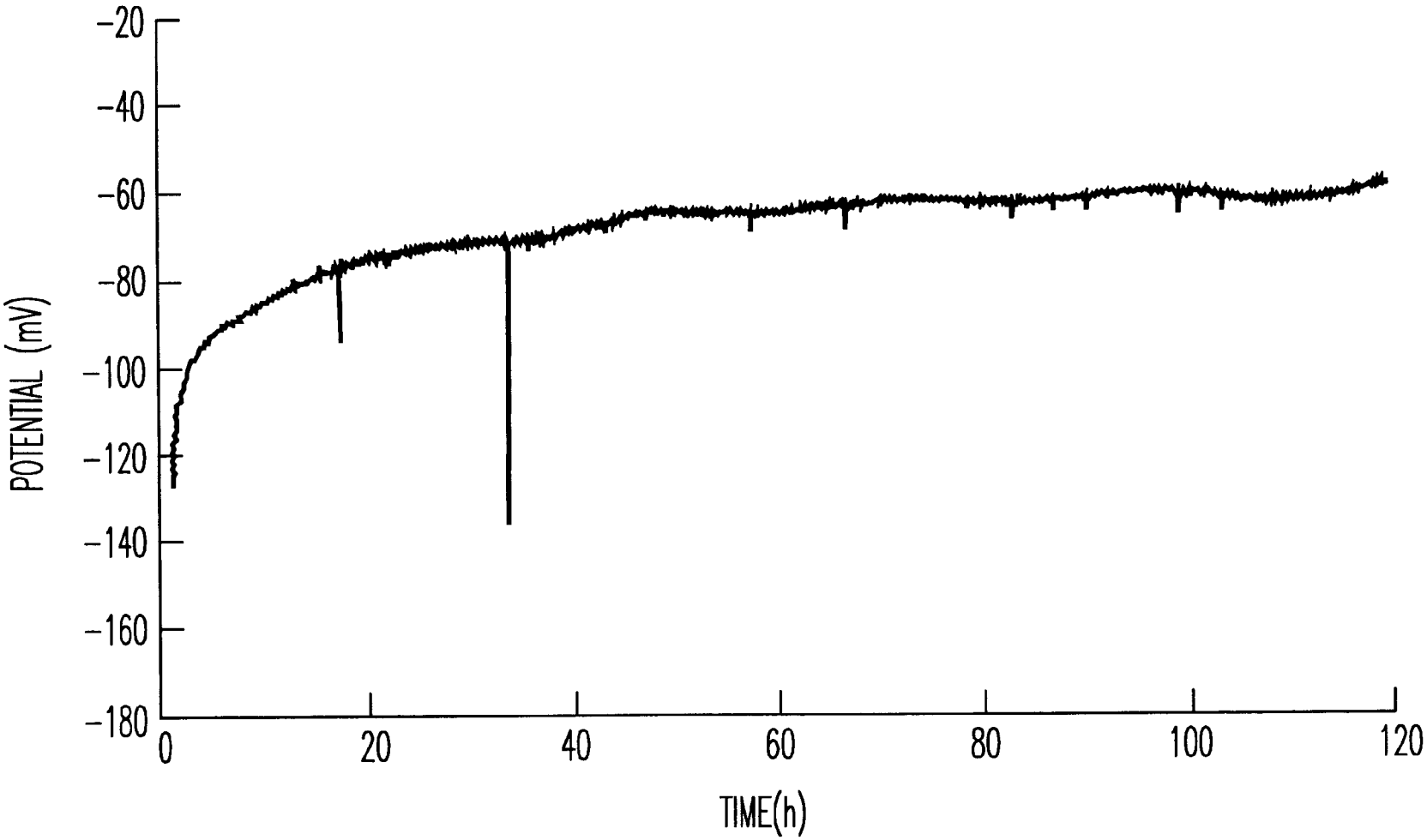
Figure 3C:
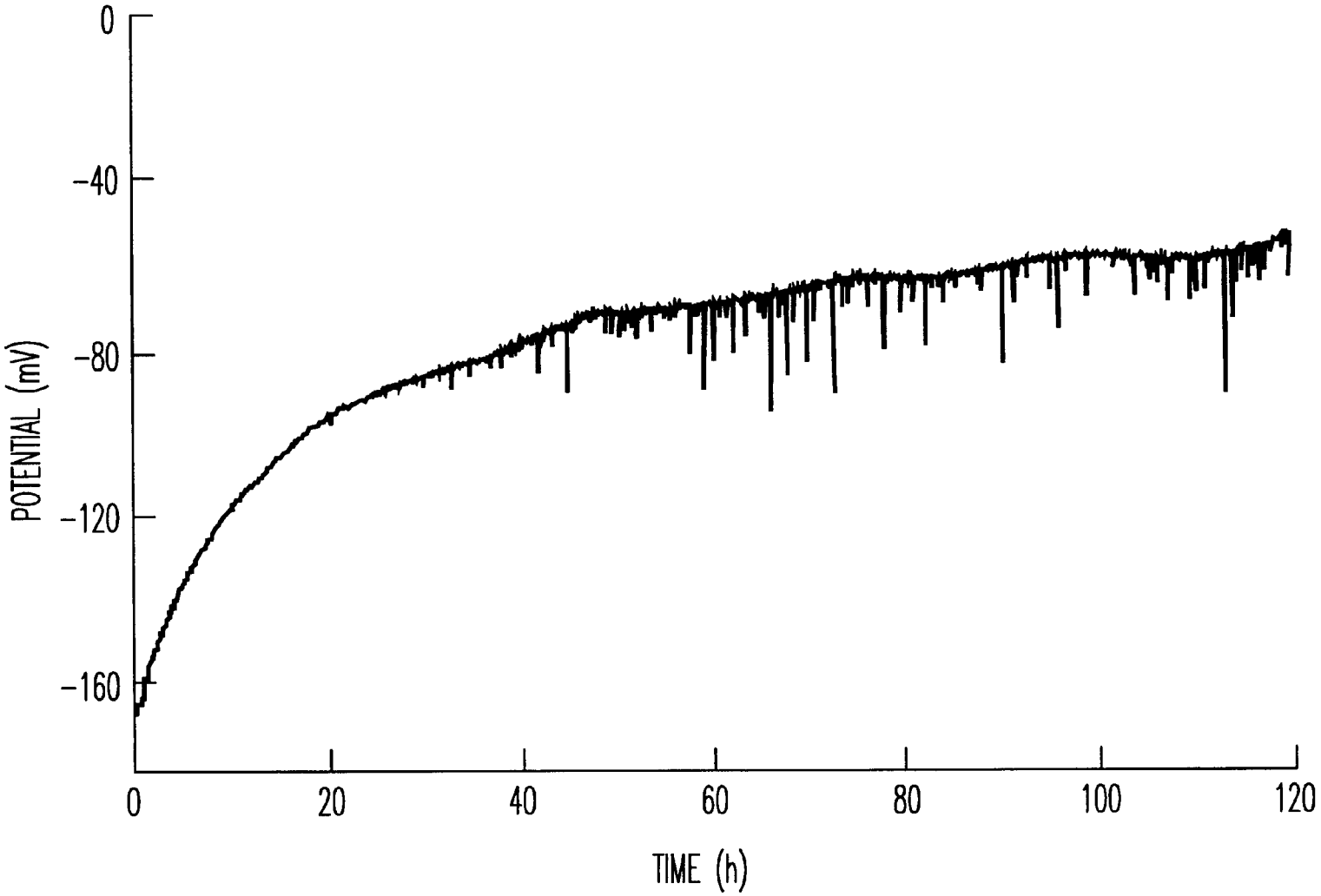
Figure 4:
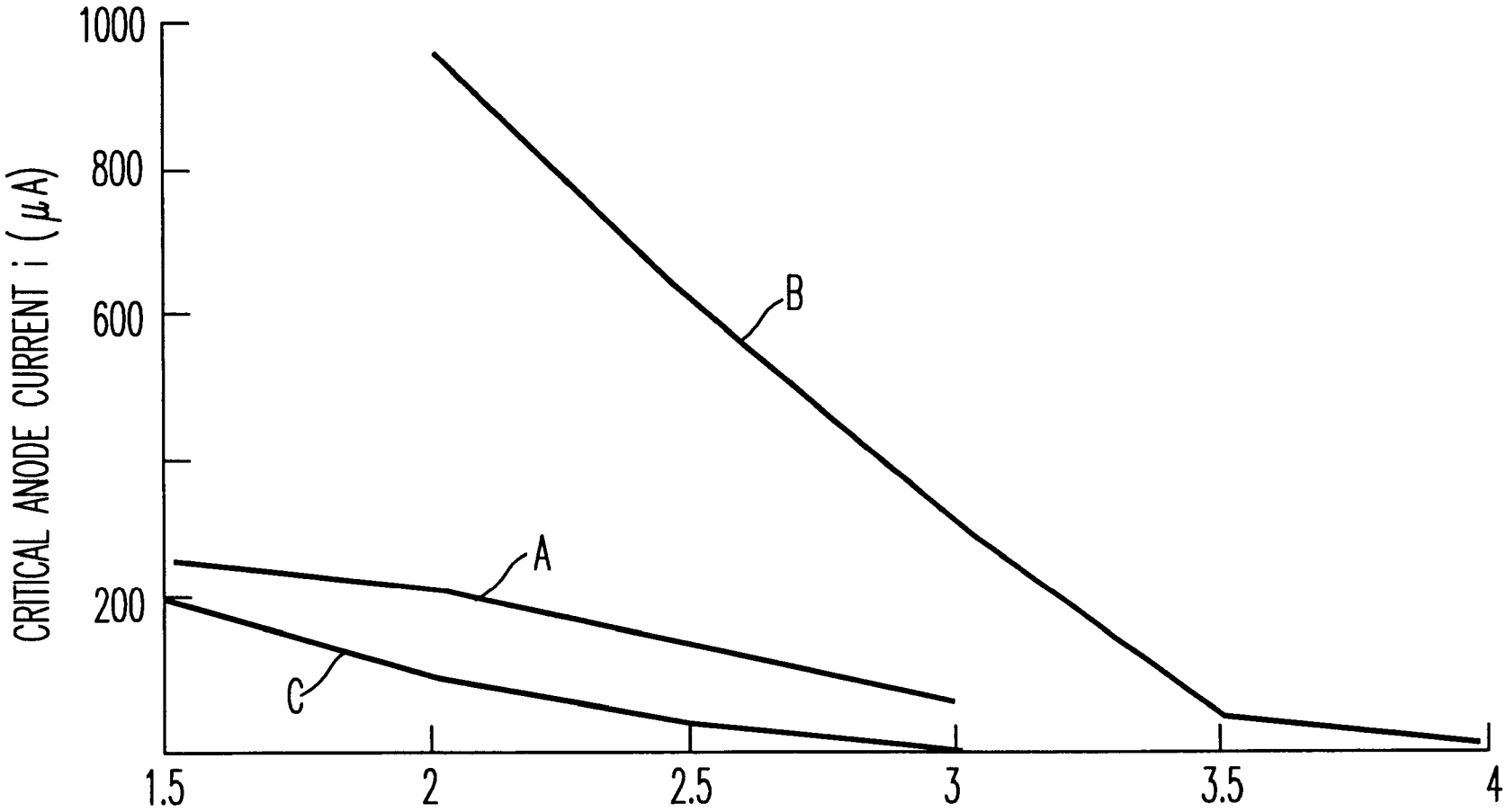

In the field of corrosion, FIGS. 3*a*,3*b* and 3*c* show the characteristic curves in pitting corrosion and in crevice corrosion for steel C according to the invention compared with reference steels A and B respectively.

In the field of machinability, drilling tests were carried out with a 4 mm diameter drill made of high-speed steel for making holes 16 mm in depth in cylindrical bars 10 mm in diameter.

Table 2 shows the performance of steels A and B and of steel C under a first cutting condition with a cutting speed of 40 m/min and a feed of 0.1 mm/revolution.

TABLE 2

| Steel | Performance, length of drilling (m) |
|---|---|
| A | 0 |
| B | >16 |
| C (Invention) | >16 |

Table 3 shows the performance of steels A, B and steel C under a second cutting condition with a cutting speed of 25 m/min and a feed of 0.25 mm/revolution.

TABLE 3

| Steel | Performance, length of drilling (m) |
|---|---|
| A | 0 |
| B | >16 |
| C (Invention) | >16 |

The solution proposed makes it possible to reconcile the best machinability possible, provided by sulfur and the associated lime aluminosilicate inclusions, with a high corrosion resistance similar to that of non-resulfurized base steels. Thus, it allows users to get around the problem of having to choose between one or other of the properties. This is because this steel allows users of non-resulfurized steels, for the production of corrosion-resistant components, to increase productivity and therefore reduce the cost of a component. Moreover, it also allows users of resulfurized steels, who then carry out a surface treatment of the chromium plating type to improve the corrosion resistance of the components, to obviate this treatment.

In view of the above teachings, one of ordinary skill would be able to make and use the invention as herein claimed in view of his background and experience.

This application is based on French patent application 00 02718 filed Mar. 3, 2000, incorporated herein by reference.

What is claimed is:

1. A resulfurized stainless steel which comprises the following composition in percent by weight based on total weight:

0.01% ≦ carbon ≦0.1%;
0.01% ≦ silicon ≦2.0%;
0.01% ≦ manganese ≦0.5%;
10% ≦ chromium ≦25%;
7% ≦ nickel ≦12%;
0.15% ≦ sulfur ≦0.45%;
0.01% ≦ molybdenum ≦3.00%;
0.5% ≦ copper ≦3.5%;
0.01% ≦ nitrogen ≦0.1%;
0.0020% ≦ aluminum ≦0.0100%;
0.0005% ≦ phosphorus ≦0.050%;
$30\times10^{-4}$% ≦ calcium ≦$200\times10^{-4}$%;
$70\times10^{-4}$% ≦ oxygen ≦$300\times10^{-4}$%;
0.20≦ calcium/oxygen ≦0.60, iron and residual elements inherent in smelting, which further comprises one or more of anorthite-, pseudo-wallastonite-, and gehlenite-type lime aluminosilicate inclusions and one or more CrMnS inclusions having a chromium content of between 30% and 70% wt. % based on total wt. of said CrMnS inclusions.

2. The steel as claimed in claim 1, wherein the composition by weight comprises less than $30\times10^{-4}$% boron.

3. The steel as claimed in claim 1, wherein the composition by weight further comprises from 0.01% to 0.3% vanadium.

4. A method of machining a resulfurized stainless steel, comprising machining the steel according to claim 1.

5. A method of machining a resulfurized stainless steel, comprising machining the steel according to claim 2.

6. A method of machining a resulfurized stainless steel, comprising machining the steel according to claim 3.

7. The method of claim 4, wherein said machining is very-high-speed machining.

8. The method of claim 5, wherein said machining is very-high-speed machining.

9. The method of claim 6, wherein said machining is very-high-speed machining.

10. The method of claim 4, wherein said machining is screw machining.

11. The method of claim 5, wherein said machining is screw machining.

12. The method of claim 6, wherein said machining is screw machining.

* * * * *